US009816767B2

(12) United States Patent
Schwalm

(10) Patent No.: US 9,816,767 B2
(45) Date of Patent: Nov. 14, 2017

(54) TUBES AND MANIFOLDS FOR HEAT EXCHANGERS

(71) Applicant: Hamilton Sundstrand Corporation, Charlotte, NC (US)

(72) Inventor: Gregory K. Schwalm, Avon, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 54 days.

(21) Appl. No.: 14/993,305

(22) Filed: Jan. 12, 2016

(65) Prior Publication Data

US 2017/0198989 A1 Jul. 13, 2017

(51) Int. Cl.
*F28F 9/02* (2006.01)
*F28F 1/02* (2006.01)

(52) U.S. Cl.
CPC ..... *F28F 9/0282* (2013.01); *F28F 1/025* (2013.01); *F28F 9/0243* (2013.01); *F28F 2009/0297* (2013.01)

(58) Field of Classification Search
CPC ..... F28F 9/0282; F28F 1/025; F28F 9/0243; Y10T 29/49368; F28D 7/06
See application file for complete search history.

(56) References Cited

U.S. PATENT DOCUMENTS 3,376,917 A * 4/1968 Smith ..... F25B 39/04 165/111
3,568,764 A * 3/1971 Newman ..... F28D 7/06 165/134.1
5,318,110 A * 6/1994 Wei ..... F28D 7/08 165/145
6,739,386 B2 5/2004 Lamich et al.
7,980,094 B2 7/2011 Yanik et al.
8,439,104 B2 5/2013 de la Cruz et al.
8,938,988 B2 1/2015 Yanik et al.
2006/0101849 A1* 5/2006 Taras ..... F25B 39/00 62/515
2010/0263847 A1 10/2010 Alahyari et al.
2013/0126141 A1 5/2013 Cho et al.

FOREIGN PATENT DOCUMENTS

DE 212012000120 U1 * 2/2014 ..... B01J 8/008
GB 1444847 A * 8/1976 ..... F28D 7/06
JP 2006078063 A * 3/2006 ..... F28F 9/0282
JP 2011106738 A * 6/2011 ..... F28F 9/0282

* cited by examiner

*Primary Examiner* — Tho V Duong
(74) *Attorney, Agent, or Firm* — Locke Lord LLP; Scott D. Wofsy; Joshua L. Jones

(57) ABSTRACT

A heat exchanger includes a manifold defining a longitudinal axis, wherein the manifold includes an interior configured for a flow of heat exchange fluid therethrough. A plurality of heat exchanger tubes are connected in fluid communication with the interior of the manifold for exchanging heat exchange fluid with the interior of the manifold. Each tube is mounted to the manifold at a tube/manifold interface. Each tube extends into the interior of the manifold from the tube/manifold interface to a respective tube end face that is spaced apart from the from the tube/manifold interface by an offset. The tube end faces collectively define a tube-end profile, e.g., a smooth profile, within the interior of the manifold.

13 Claims, 2 Drawing Sheets

Fig. 3
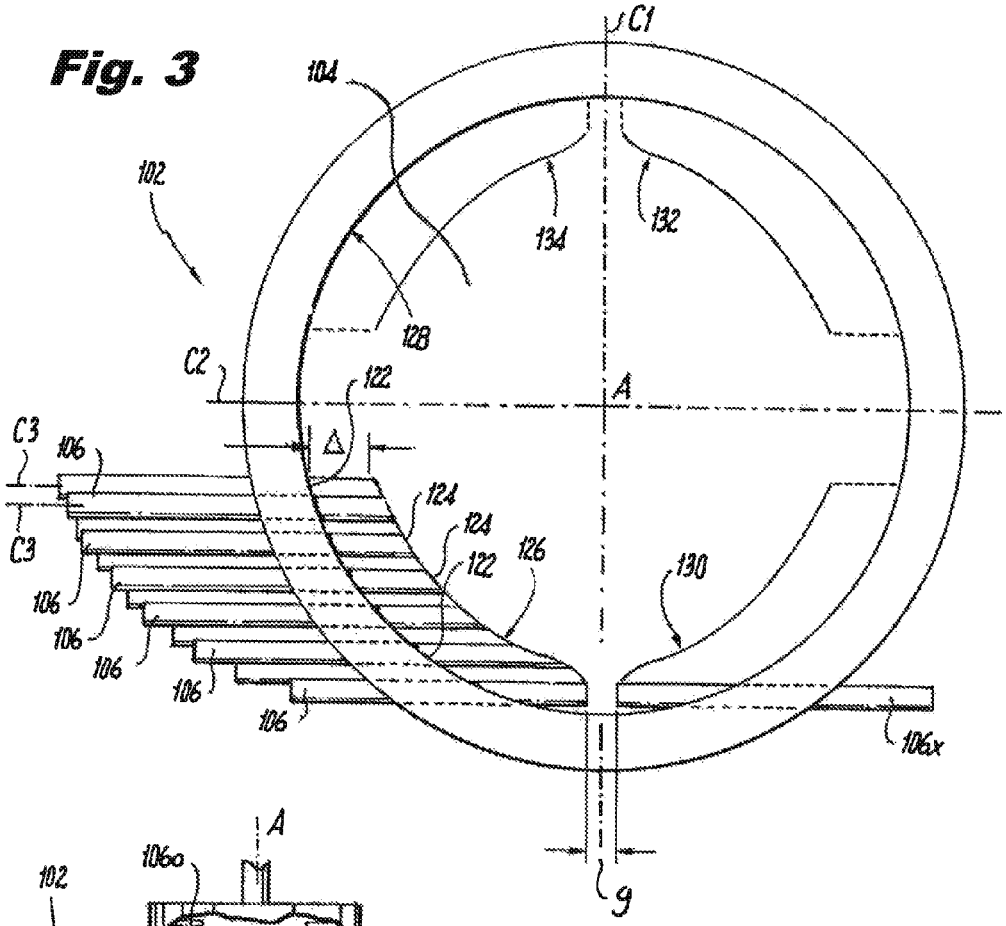
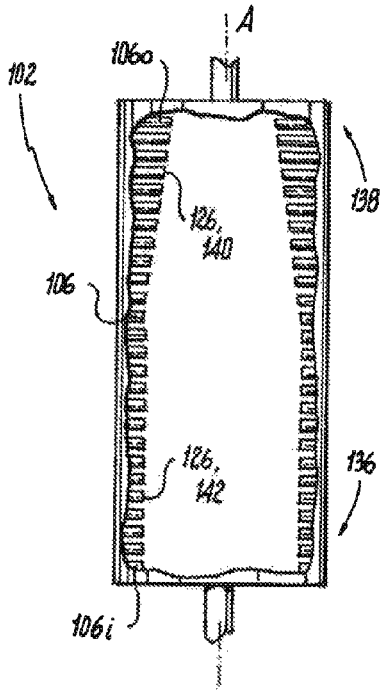
Fig. 4

TUBES AND MANIFOLDS FOR HEAT EXCHANGERS

STATEMENT REGARDING FEDERALLY SPONSORED RESEARCH OR DEVELOPMENT

This invention was made with government support under Air Force Research Lab Contract No. FA8650-09-D-2929 DO 0021 awarded by the United States Air Force. The government has certain rights in the invention.

BACKGROUND OF THE INVENTION

1. Field of the Invention

The present disclosure relates to heat exchangers, and more particularly to tubes and manifolds such as used in shell and tube heat exchangers.

2. Description of Related Art

Traditional tube shell heat exchangers have been designed with manifolds with cylindrical cross-sections to handle high pressures. An example of such a manifold 10 is shown in FIG. 1. When these heat exchangers are subjected to rapid changes in temperature of the high pressure fluid, there are significant temperature gradients in the assembly with resultant high stresses and strains into the plastic region at the tube/manifold interface that can ultimately result in cracking of the heat exchanger, severely shortening the useful life of the unit.

There is often a higher heat transfer coefficient near the high pressure fluid tube inlets (the small tube openings within the larger cylindrical manifold 10 shown in FIG. 1) due to a vena contracta within each tube near the tube inlet. The heat transfer coefficient in each tube has a peak value near the vena contracta and reduces in magnitude within each tube downstream of the vena contracta. The vena contracta effect causes high heat transfer coefficients at the tube/manifold interface, making this interface a location of peak thermally induced stress and strain.

In one particular version of a tube shell heat exchanger, the multiple tubes exiting the high pressure cylindrical manifold are parallel to each other, with the tubes furthest from the manifold centerline being more tangent to the manifold inner diameter, such as the lower most tubes as oriented in FIG. 1. Many of the tubes are cut to leave a distance between the inner manifold surface and tube end (referred to as standoff), with the tube ends roughly parallel to the inner manifold surface. The result is the tubes closer to tangent to the manifold inner diameter having a sharper point, i.e., having ends cut an angle further from normal to the tube's flow axis compared to tubes near the centerline of the manifold. This in turn results in larger vena contracta effects in these tangent tubes, with resultant high velocities on the tube wall opposite the vena contracta, high heat transfer coefficients, high thermal gradients, and high plastic strains during thermal transients. The more tangent tubes, e.g., the tubes near the bottom of the device shown in FIG. 1, present a design limitation for heat exchangers of this type, since the greatest thermal stress and strain tend to occur at the tube/manifold interface for these tubes.

Such conventional methods and systems have generally been considered satisfactory for their intended purpose. However, there is still a need in the art for improved tubes and manifolds for heat exchangers. The present disclosure provides a solution for this need.

SUMMARY OF THE INVENTION

A heat exchanger includes a manifold defining a longitudinal axis, wherein the manifold includes an interior configured for a flow of heat exchange fluid therethrough. A plurality of heat exchanger tubes are connected in fluid communication with the interior of the manifold for exchanging heat exchange fluid with the interior of the manifold. Each tube is mounted to the manifold at a tube/manifold interface. Each tube extends into the interior of the manifold from the tube/manifold interface to a respective tube end face that is spaced apart from the from the tube/manifold interface by an offset. The tube end faces collectively define a tube-end profile, e.g., a smooth profile, within the interior of the manifold.

Each tube can have a single opening within the interior of the manifold, and has a tube wall separate and spaced apart from the other tubes. The respective offsets of the tubes can vary from tube to tube and the tube-end profile can deviate in shape from a surface defining the interior of the manifold. For at least some of the tubes the respective offsets of the tubes can be a function of angle of each respective tube end face relative to the respective tube, wherein the greater the angle, the greater the offset. The tube-end profile can vary smoothly from a surface defining the interior of the manifold in both radial and axial directions relative to the longitudinal axis.

A heat exchanger shell can at least partially enclose the manifold and tubes within an envelope. A first flow circuit can be defined in the manifold and tubes. A second flow circuit fluidly isolated from the first flow circuit can be defined in the envelope inside the heat exchanger and outside of the tubes and manifold for heat exchange between the first and second flow circuits. Both of the first and second flow circuits can be configured to be pressurized above or below the environment external to the heat exchanger shell.

The tubes can be parallel to one another, wherein a first one of the tubes is less tangent to a surface defining the interior of the manifold than is a second one of the tubes. The tube-end profile can be offset from and can conform to the surface defining the interior of the manifold at the first one of the tubes, and can extend circumferentially to the second one of the tubes, where the tube-end profile can deviate from the surface defining the interior of the manifold. The tube-end profile at the second one of the tubes can be normal to the second one of the tubes.

The tubes can include a first subset of tubes, including the first one of the tubes and the second one of the tubes, wherein the first subset of the tubes extends into the interior of the manifold from a first direction. The tubes can include a second subset of tubes opposite the first subset of tubes, wherein the second subset of tubes defines a tube-end profile symmetrical with that of the first subset of tubes across a manifold centerline. The second one of the tubes of the first subset can be across the manifold centerline from a corresponding tube of the second subset of tubes and can be separated therefrom by a gap.

The tubes can include an inlet end tube at an inlet end of the manifold and an outlet end tube at an outlet end of the manifold. The tube-end profile can include a tapered section that tapers along an axial direction relative to the longitudinal axis such that the outlet end tube reaches closer to the longitudinal axis than the inlet end tube. The outlet end tube can be one of a plurality of circumferentially spaced outlet end tubes at the outlet end of the manifold, wherein the outlet end tubes are all spaced apart from the longitudinal axis.

The tube-end profile can include a cylindrical section extending along an axial direction relative to the longitudinal axis such that the tubes of the cylindrical section, including the inlet end tube, are evenly spaced from the longitudinal axis in a direction perpendicular to the longitudinal axis. The tube-end profile can transition smoothly from the tapered section to the cylindrical section.

A heat exchanging arrangement includes a manifold having a wall with an inner surface defining an interior volume. A plurality of tubes protrude through the wall and an end of each of the plurality of tubes is offset a dimension, e.g., a distance, from the inner surface such that the ends of the plurality of tubes define a tube-end profile that differs in shape from a shape of the inner surface.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 3 is a schematic axial end view of the tube/manifold interface of the heat exchanger of FIG. 2, showing the tube-end profile in the circumferential direction; and FIG. 4 is a schematic side elevation view of the tube/manifold interface of the heat exchanger of FIG. 2, showing the tube-end profile in the axial direction.

DETAILED DESCRIPTION OF THE PREFERRED EMBODIMENTS

Figure 1:
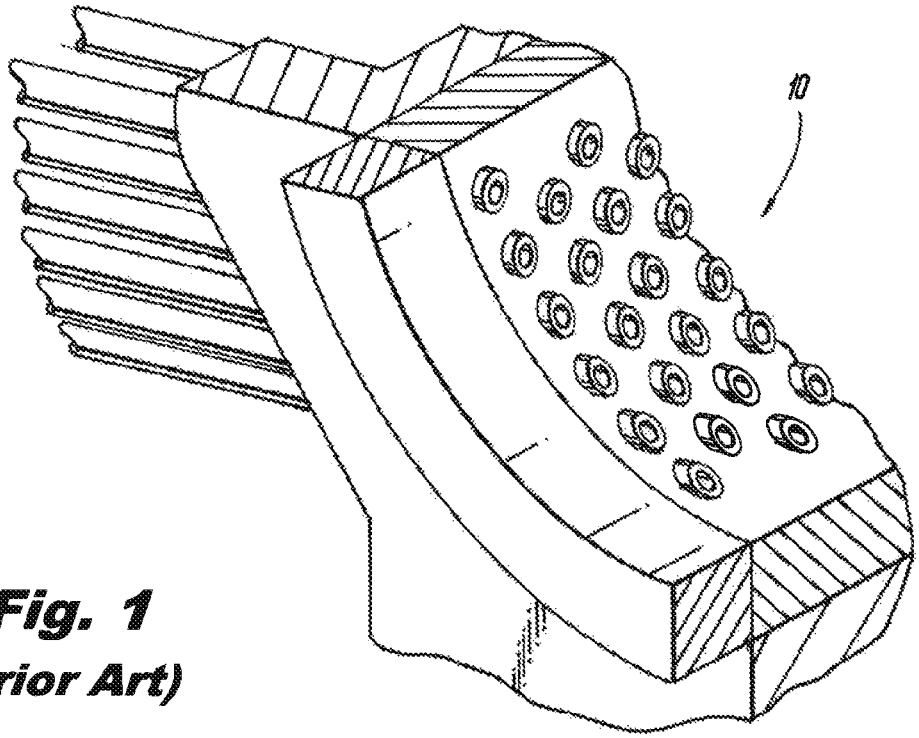
Fig. 1 (Prior Art)
FIG. 1 is a perspective view of a portion of a prior art heat exchanger, showing the tube/manifold interface.
Figure 2:
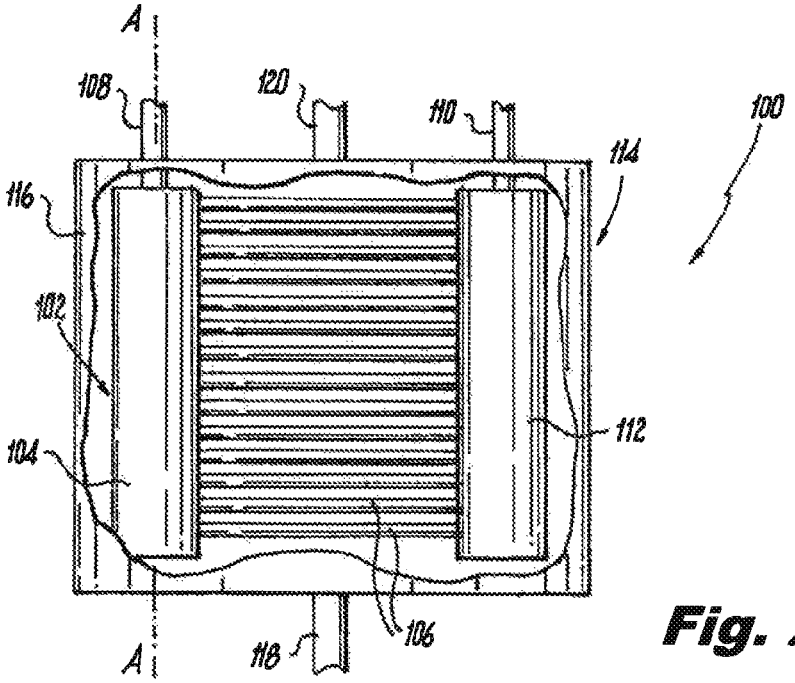
FIG. 2 is a schematic view of an exemplary embodiment of a heat exchanger constructed in accordance with the present disclosure, showing the shell and tube configuration.

Reference will now be made to the drawings wherein like reference numerals identify similar structural features or aspects of the subject disclosure. For purposes of explanation and illustration, and not limitation, a partial view of an exemplary embodiment of a heat exchanger in accordance with the disclosure is shown in FIG. 2 and is designated generally by reference character 100. Other embodiments of heat exchangers in accordance with the disclosure, or aspects thereof, are provided in FIGS. 3-4, as will be described. The systems and methods described herein can be used to reduce weight and improve performance, operational life, and manufacturability of heat exchangers, such as in tube and shell configurations.

A heat exchanger 100 includes a manifold 102 defining a longitudinal axis A, wherein the manifold includes an interior 104 configured for a flow of heat exchange fluid therethrough. A plurality of heat exchanger tubes 106 are connected in fluid communication with the interior 104 of the manifold 102 for exchanging heat exchange fluid with the interior 104 of the manifold 102. In this example, pressurized fluid enters interior 104 of manifold 102 through manifold inlet 108, passes into tubes 106, and leaves heat exchanger 100 through the outlet 110 of a second manifold 112. A first flow circuit is thus defined in the manifold 102 and tubes 106, including the second manifold 112. Each tube 106 has a single opening within the interior 104 of the manifold, and has a tube wall separate and spaced apart from the other tubes 106.

A heat exchanger shell 114 at least partially encloses the manifolds 102 and 112 and tubes 106 within an envelope 116. Shell 114 includes an inlet 118 which feeds fluid into envelope 116, and an outlet 120 through which fluid leaves envelope 116. Thus second flow circuit fluidly isolated from the first flow circuit is defined in the envelope 116 inside the heat exchanger 100 and outside of the tubes 106 and manifolds 102 and 112 for heat exchange between fluids circulating through the first and second flow circuits. Both of the first and second flow circuits are configured to be pressurized above or below the environment external to the heat exchanger shell 114.

With reference now to FIG. 3, each tube 106 is mounted to the manifold 102 at a tube/manifold interface 122, only two of which are indicated in FIG. 3 for sake of clarity. Each tube 106 extends into the interior 104 of the manifold 102 from the tube/manifold interface 122 to a respective tube end face 124 offset distance Δ from the tube/manifold interface 122. The tube end faces 124 collectively define a smooth tube-end profile 126 within the interior 104 of the manifold 102.

The offset distance Δ for each tube 106 varies from tube to tube and the tube-end profile deviates from the shape of the surface 128 of the wall defining the interior 104 of the manifold 102. For at least some of the tubes 106, e.g., the upper tubes 106 as oriented in FIG. 3, the respective offset distances of the tubes Δ are a function of angle of each respective tube end face 124 relative to the length of the respective tube 106, wherein the greater the angle of the end face 124, the greater the offset distance Δ for some or most of the tubes. This trend is true as the tubes are located further away from the manifold centerline, but the trend may not hold all the way to the lower, most tangent tubes in certain applications. This could result in the "keyhole" cut at the bottom of the manifold (represented by gap g) being wider than shown, or having a cut angle further from perpendicular to the tube axis. Offset distance Δ can be determined for each tube as the distance along the centerline c3 of the respective tube (for sake of clarity not all of the centerline axes c3 are labeled in the drawings), from where the center line crosses surface 128 to where the centerline passes through the respective end face 124. The tube-end profile 126 varies smoothly from surface 128 in both radial and axial directions relative to the longitudinal axis A (which in FIG. 3 extends into and out of the plane of the view).

In one embodiment the tubes 106 are parallel to one another, wherein a first one of the tubes, e.g., the top most tube 106 shown in FIG. 3, is less tangent to surface 128 than is a second one of the tubes, e.g., the lower most tube 106 in FIG. 3. The tube-end profile 126 is offset from and conforms to surface 128 near the upper most tube 106 in FIG. 3, and extends circumferentially around manifold 102 to the lower most tube 106 in FIG. 3, where the tube-end profile 126 deviates from the surface 128. In other words, as oriented in FIG. 3, the upper end of profile 126 roughly conforms to, but is offset from, surface 128, but profile 126 transitions circumferentially and at its lower end, profile 126 does not conform to surface 128. In this example, the lower end of profile 126 is substantially perpendicular to surface 128. The tube-end profile 126 at the lower most tube 106 in FIG. 3 is substantially normal to the centerline of that tube 106. Profile 126 results in several tubes 106 having ends that are cut nearer to perpendicular to the tube's axis than would be the case if the ends were cut to conform to the shape of surface 128.

The tubes 106 include a first subset of tubes wherein the first subset of the tubes 106 extends into the interior 104 of the manifold 102 from a first direction, e.g., from the left as oriented in FIG. 3. A second subset of tubes can be included opposite the first subset of tubes 106, wherein the second subset of tubes defines a tube-end profile 130 symmetrical with profile 126 across a manifold centerline C1. Two additional subsets of tubes 106 are included, symmetrical with the first two subsets across centerline C2 of manifold 102. Not all of the tubes 106 are shown in FIG. 3 for sake of clarity, however, the respective tube-end profiles 130, 132, and 134 are shown schematically. The lower most tube 106 in FIG. 3 is across the manifold centerline C1 from a corresponding tube 106*x* of the second subset of tubes 106 and is separated therefrom by a gap g. Although the spacing between the ends of the bottom-most tubes 106 and 106*x* can be tight, i.e., gap g can be small, the added pressure drop incurred due to flow passing from the manifold 102 into these lower most tubes 106 and 107 is small because there tends to be relatively little flow in the manifold 102 at this particular location.

With reference now to FIG. 4, the tubes 106 include an inlet end tube 106*i* at an inlet end 136 of the manifold and an outlet end tube 106*o* at an outlet end 138 of the manifold 102. The tube-end profile 126 includes a conic section 140 that tapers along an axial direction relative to the longitudinal axis A such that the outlet end tube 106*o* reaches closer to the longitudinal axis A than the inlet end tube 106*i*. The outlet end tube 106*o* is one of a plurality of circumferentially spaced outlet end tubes 106 at the outlet end 138 of the manifold 102. The outlet end tubes are all spaced apart from the longitudinal axis. Conical section 140 accommodates for tube/manifold interface stresses and pressure drop along the length of manifold 102 to provide even flow to tubes 106 near outlet end 138. Those skilled in the art will readily appreciate that conic section 140 can be curved, e.g., as in a bell-shaped profile, straight conic, or of any other suitable tapered profile.

The tube-end profile 126 also includes a cylindrical section 142 extending along an axial direction relative to the longitudinal axis A such that the tubes 106 of the cylindrical section 142, including the inlet end tube 106*i*, are evenly spaced from the longitudinal axis A in a direction perpendicular to the longitudinal axis A. The tube-end profile 126 transitions smoothly from the conic section 140 to the cylindrical section 142.

While described herein in the exemplary context of a tube shell heat exchanger with a cylindrical manifold shape, those skilled in the art will readily appreciate that the principles disclosed herein can readily be applied to any other suitable type of heat exchanger, such as high pressure/high temperature manifold systems with cylindrical or other non-uniform high pressure manifold shapes, without departing from the scope of this disclosure.

Potential benefits of the tube and manifold configurations disclosed herein include the high pressure side tubes can be extended into the inlet manifold beyond the manifold inner diameter to reduce the magnitude of the heat transfer coefficient occurring near the tube/manifold interface and hence reduce peak temperature gradients and resultant plastic strains due to thermal transients in this region of the heat exchanger. Also, because the tube banks can be staggered along the length of the manifold, the shape of the smooth tube-end profile in both the circumferential and axial directions relative to the manifold longitudinal axis can allow cost-effective, high quality manufacture of the heat exchanger with an electrical discharge machining (EDM) plunge cut operation, or any other suitable process.

The methods and systems of the present disclosure, as described above and shown in the drawings, provide for heat exchangers with superior properties including improved tube/manifold interfaces relative to traditional heat exchangers. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A heat exchanger comprising:

a manifold defining a longitudinal axis, wherein the manifold includes an interior configured for a flow of heat exchange fluid therethrough; and a plurality of heat exchanger tubes connected in fluid communication with the interior of the manifold, each of the tubes being mounted to the manifold at a tube/manifold interface, wherein each of the tubes extends into the interior of the manifold from the tube/manifold interface to a respective tube end face that is spaced apart from the tube/manifold interface by an offset distance, and wherein the respective tube end faces of the tubes collectively define a tube-end profile within the interior of the manifold, wherein the respective offset distances of the tubes vary from tube to tube and wherein the tube-end profile deviates in shape from a surface defining the interior of the manifold, wherein for at least some of the tubes the respective offset distances of the tubes are a function of angle of each respective tube end face relative to the respective tube, wherein the greater the angle, the greater the offset distance.

2. The heat exchanger as recited in claim 1, wherein each of the tubes has a single opening within the interior of the manifold, and has a tube wall separate and spaced apart from the other tubes.

3. The heat exchanger as recited in claim 1, wherein the tube-end profile varies smoothly from a surface defining the interior of the manifold in both radial and axial directions relative to the longitudinal axis.

4. The heat exchanger as recited in claim 1, further comprising:

a heat exchanger shell at least partially enclosing the manifold and tubes within an envelope, wherein a first flow circuit is defined in the manifold and tubes, wherein a second flow circuit fluidly isolated from the first flow circuit is defined in the envelope inside the heat exchanger and outside of the tubes and manifold for heat exchange between the first and second flow circuits wherein both of the first and second flow circuits are configured to be pressurized above or below the environment external to the heat exchanger shell.

5. The heat exchanger as recited in claim 1, wherein the tubes are parallel to one another, wherein a first one of the tubes is less tangent to a surface defining the interior of the manifold than is a second one of the tubes, wherein the tube-end profile is offset from and conforms to the surface defining the interior of the manifold at the first one of the tubes, and extends circumferentially to the second one of the tubes, where the tube-end profile deviates from the surface defining the interior of the manifold.

6. The heat exchanger as recited in claim 5, wherein the tube-end profile at the second one of the tubes is normal to the second one of the tubes.

7. The heat exchanger as recited in claim 5, wherein the tubes include a first subset of tubes, including the first one of the tubes and the second one of the tubes, wherein the first subset of the tubes extends into the interior of the manifold from a first direction, wherein the tubes include a second subset of tubes opposite the first subset of tubes, wherein the second subset of tubes defines a tube-end profile symmetrical with that of the first subset of tubes across a manifold centerline.

8. The heat exchanger as recited in claim 7, wherein the second one of the tubes of the first subset is across the manifold centerline from a corresponding tube of the second subset of tubes and is separated therefrom by a gap.

9. The heat exchanger as recited in claim 1, wherein the tubes include an inlet end tube at an inlet end of the manifold and an outlet end tube at an outlet end of the manifold, wherein the tube-end profile includes a section that tapers along an axial direction relative to the longitudinal axis such that the outlet end tube reaches closer to the longitudinal axis than the inlet end tube.

10. A heat exchanger comprising:

a manifold defining a longitudinal axis, wherein the manifold includes an interior configured for a flow of heat exchange fluid therethrough; and a plurality of heat exchanger tubes connected in fluid communication with the interior of the manifold, each of the tubes being mounted to the manifold at a tube/manifold interface, wherein each of the tubes extends into the interior of the manifold from the tube/manifold interface to a respective tube end face that is spaced apart from the tube/manifold interface by an offset distance, and wherein the respective tube end faces of the tubes collectively define a tube-end profile within the interior of the manifold, wherein the tubes include an inlet end tube at an inlet end of the manifold and an outlet end tube at an outlet end of the manifold, wherein the tube-end profile includes a section that tapers along an axial direction relative to the longitudinal axis such that the outlet end tube reaches closer to the longitudinal axis than the inlet end tube, wherein the outlet end tube is one of a plurality of circumferentially spaced outlet end tubes at the outlet end of the manifold, wherein the outlet end tubes are all spaced apart from the longitudinal axis.

11. The heat exchanger as recited in claim 1, wherein the tubes include an inlet end tube at an inlet end of the manifold and an outlet end tube at an outlet end of the manifold, wherein the tube-end profile includes a cylindrical section extending along an axial direction relative to the longitudinal axis such that the tubes of the cylindrical section, including the inlet end tube, are evenly spaced from the longitudinal axis in a direction perpendicular to the longitudinal axis.

12. A heat exchanger comprising:

a manifold defining a longitudinal axis, wherein the manifold includes an interior configured for a flow of heat exchange fluid therethrough; and a plurality of heat exchanger tubes connected in fluid communication with the interior of the manifold, each of the tubes being mounted to the manifold at a tube/manifold interface, wherein each of the tubes extends into the interior of the manifold from the tube/manifold interface to a respective tube end face that is spaced apart from the tube/manifold interface by an offset distance, and wherein the respective tube end faces of the tubes collectively define a tube-end profile within the interior of the manifold, wherein the tubes include an inlet end tube at an inlet end of the manifold and an outlet end tube at an outlet end of the manifold, wherein the tube-end profile includes:

a tapered section that tapers along an axial direction relative to the longitudinal axis such that the outlet end tube reaches closer to the longitudinal axis than the inlet end tube; and a cylindrical section extending along an axial direction relative to the longitudinal axis such that the tubes of the cylindrical section, including the inlet end tube, are evenly spaced from the longitudinal axis in a direction perpendicular to the longitudinal axis.

13. The heat exchanger as recited in claim 12, wherein the tube-end profile transitions smoothly from the tapered section to the cylindrical section.

* * * * *